US007418809B2

(12) United States Patent
Martelli

(10) Patent No.: US 7,418,809 B2
(45) Date of Patent: Sep. 2, 2008

(54) DEVICE FOR PICKING AND OPENING BOXES SUITABLE FOR PACKAGING PRODUCTS

(75) Inventor: Antonio Martelli, Bologna (IT)

(73) Assignee: O.A.M. Societa' per Azioni, Pianoro (IT)

( * ) Notice: Subject to any disclaimer, the term of this patent is extended or adjusted under 35 U.S.C. 154(b) by 0 days.

(21) Appl. No.: 11/376,215

(22) Filed: Mar. 16, 2006

(65) Prior Publication Data

US 2006/0243786 A1 Nov. 2, 2006

(30) Foreign Application Priority Data

Apr. 1, 2005 (IT) ..... BO2005A0212

(51) Int. Cl.
*B65B 43/26* (2006.01)

(52) U.S. Cl. ..... 53/564; 53/381.1; 493/309

(58) Field of Classification Search ..... 53/564, 53/566, 381.1, 458; 493/309, 313, 312
See application file for complete search history.

(56) References Cited

U.S. PATENT DOCUMENTS 1,298,367 A * 3/1919 Macfie ..... 180/9.32
2,671,385 A 3/1954 Johenning et al.
4,685,275 A * 8/1987 Nigrelli, Sr. ..... 53/458
4,735,600 A * 4/1988 Drewke et al. ..... 493/314
5,019,029 A * 5/1991 Calvert ..... 493/315
5,415,615 A * 5/1995 Culpepper ..... 493/315
5,454,215 A * 10/1995 Martelli ..... 53/564
5,473,868 A * 12/1995 Antonio ..... 53/566
5,562,581 A * 10/1996 Roberto et al. ..... 493/310
5,613,828 A * 3/1997 Haddow et al. ..... 414/798.9
6,073,423 A * 6/2000 House et al. ..... 53/564

FOREIGN PATENT DOCUMENTS

EP 0 569 340 A1 11/1993
GB 1 269 377 A 4/1972
GB 2 053 133 A 2/1981
JP 07 223614 A 8/1995

* cited by examiner

*Primary Examiner*—Sameh H. Tawfik
(74) *Attorney, Agent, or Firm*—Modiano & Associati; Albert Josif; Daniel J. O'Byrne

(57) ABSTRACT

A device for picking and opening boxes suitable for packaging products, comprising at least one magazine for substantially parallelepipedal boxes in a flattened configuration, at least one rotating drum provided peripherally with elements for picking the boxes one by one from the magazine and with elements for opening the boxes, and at least one conveyor for conveying the boxes in the open configuration from the rotating drum toward successive production stations of the product packaging process, the box picking elements and the box opening elements being actuated by cams, the conveyor comprising at least one rotating carousel with a plurality of box seats.

16 Claims, 5 Drawing Sheets

DEVICE FOR PICKING AND OPENING BOXES SUITABLE FOR PACKAGING PRODUCTS

The present invention relates to a device for picking and opening boxes suitable for packaging products.

BACKGROUND OF THE INVENTION

Apparatuses are known which are suitable to package products of various types and sizes by automated insertion of such products in boxes which are shaped substantially like a parallelepiped and are made for example of cardboard or other similar materials. The boxes are usually of the type which is fed in a substantially flattened configuration providing minimum space occupation, i.e., folded along the longitudinal edges.

Some of the known types of apparatus provide sequentially certain fundamental production steps; in particular, they first pick each box from an appropriately provided magazine, then open the boxes to make them assume a parallelepipedal configuration, and finally deposit them, substantially by gravity, on a sort of horizontal conveyor of the belt or chain type or the like, which then transfers them in an orderly fashion toward successive production stations, including mainly the station for filling with the products to be packaged (for example large and small bottles, tubes, blister packages and others). An apparatus of this kind is described in Invention U.S. Pat. No. 1,298,367 in the name of this same Applicant.

These apparatuses are provided usually with a horizontal conveyor, which moves in a closed circuit along a substantially annular path, for example with at least two straight portions connected by curved portions. The continuous motion of the conveyor, provided with the boxes to be filled, along the path described above therefore entails the onset of accelerations and dynamic actions which limit excessively the production rate of the apparatus in relation to the actual requirements of the market.

SUMMARY OF THE INVENTION

The aim of the present invention is to obviate the above-mentioned drawback, by providing a device for picking and opening boxes suitable for packaging products, which can operate at a significantly faster production rate than known and traditional types of apparatus.

Within this aim, an object of the present invention is to provide a device for picking and opening boxes suitable for packaging products which is precise and reliable in operation.

Another object of the present invention is to provide a device for picking and opening boxes suitable for packaging products which is adapted to process boxes of different formats in an extremely flexible and versatile manner.

A further object of the present invention is to achieve such aim with a structure which is simple, relatively easy to provide in practice, safe in use, effective in operation, and has a relatively low cost.

This aim and these and other objects that will become better apparent hereinafter are achieved by the present device for picking and opening boxes suitable for packaging products, of the type which comprises at least one magazine for substantially parallelepipedal boxes in a flattened configuration, at least one rotating drum which is provided peripherally with elements for picking the boxes one by one from said magazine and with means for opening the boxes, and at least one conveyor for conveying the boxes in the open configuration from said rotating drum toward successive production stations of the product packaging process, said box picking elements and said box opening means being actuated by cam means, said picking elements being of the articulated type provided with means for gripping the boxes from said magazine and for releasing the boxes into said conveyor, characterized in that said conveyor comprises at least one rotating carousel, which has a rotation axis which is parallel to the axis of said drum and forms a plurality of peripheral seats, which are adapted to accommodate the boxes in the open configuration deposited by said grip and release means so as to convey them in an orderly fashion towards said subsequent production stations.

BRIEF DESCRIPTION OF THE DRAWINGS

Further characteristics and advantages of the invention will become better apparent from the following detailed description of a preferred but not exclusive embodiment of a device for picking and opening boxes suitable for packaging products according to the invention, illustrated by way of non-limiting example in the accompanying drawings, wherein.

DESCRIPTION OF THE PREFERRED EMBODIMENTS

Figure 1:
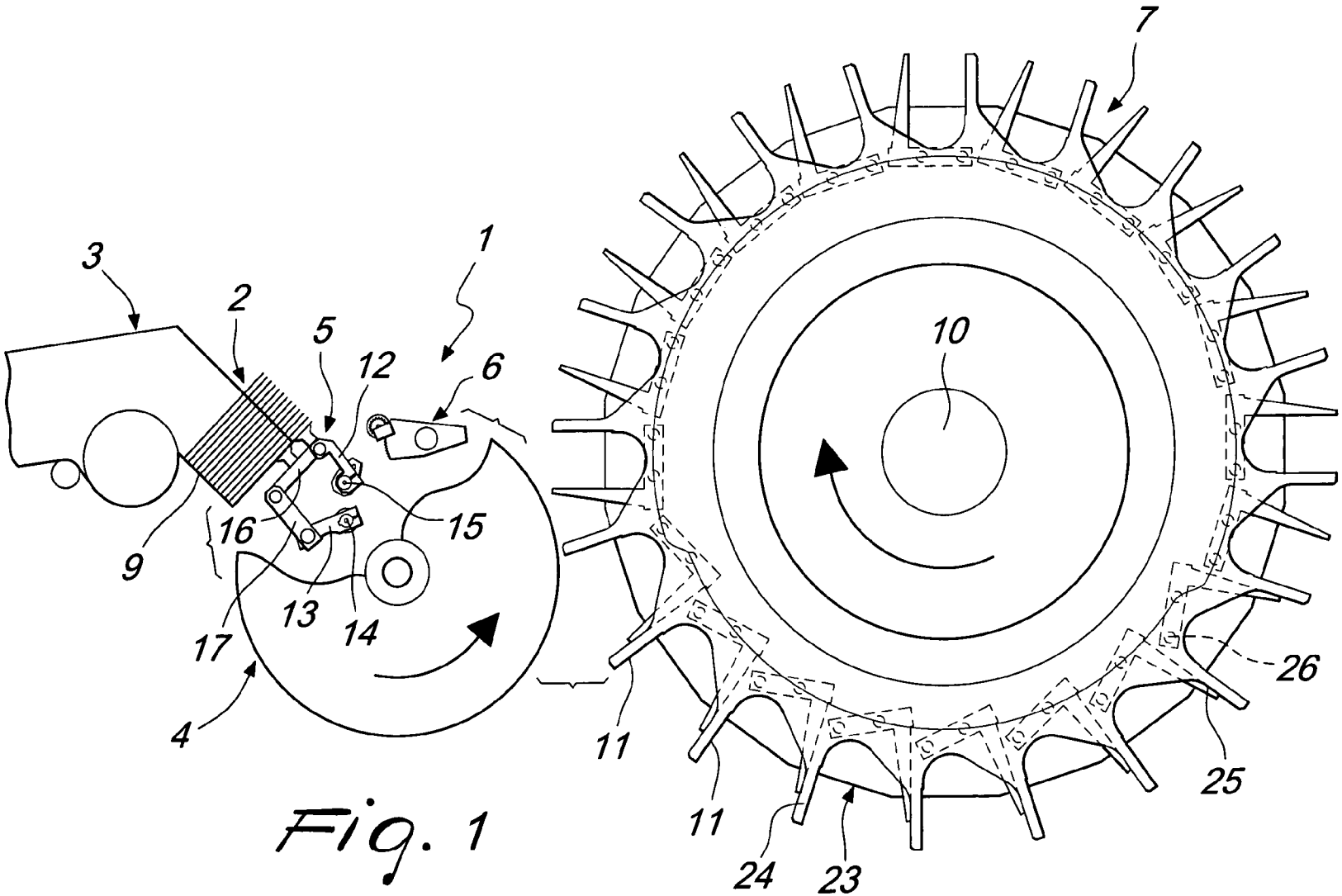
FIG. 1 is a detail front view of the device according to the invention, in a step of the picking of a box from the magazine.

In the exemplary embodiments that follow, individual characteristics, given in relation to specific examples, may actually be interchanged with other different characteristics that exist in other exemplary embodiments.

Moreover, it is to be noted that anything found to be already known during the patenting process is understood not to be claimed and to be the subject of a disclaimer.

With reference to the figures, the reference numeral 1 generally designates a device for picking and opening boxes suitable for packaging products according to the invention.

The described device is of the type particularly suitable to package products of any kind in boxes, for example made of cardboard or other lightweight material, which are substantially shaped like parallelepipeds of various dimensions. Each one of the boxes, generally designated by the reference numeral 2, comprises at least one upper wall, a lower wall and four side walls 2*a*, 2*b*, 2*c*, 2*d*, which, when the box 2 is in the open configuration, are mutually substantially perpendicular (reference should be made, for example, to FIG. 3 and to the subsequent figures).

The device 1, supported on a footing which is not shown in the figures for the sake of simplicity, is of the type which comprises at least one magazine, generally designated by the reference numeral 3, for boxes 2 which are packed in a flattened configuration, and at least one rotating drum, generally designated by the reference numeral 4, which has a horizontal rotation axis and is provided peripherally with elements 5 for picking the boxes 2 one by one from the magazine and with means 6 for opening the boxes 2 from the flattened configuration to the configuration for inserting the products therein; the device 1 further comprises at least one conveyor, generally designated by the reference numeral 7, for conveying the boxes 2 in the open configuration from the rotating drum 4 toward subsequent production stations of the product packaging process. These subsequent production stations can be constituted, merely by way of non-limiting example, by a station for filling the boxes 2 with the products to be packaged and/or by other required stations (for example, labeling or others).

In particular, the picking elements 5 and the opening means 6 for the boxes are conveniently actuated by cam means, which are not shown for the sake of simplicity and clarity in the figures and are of a substantially known type, said means being described extensively in the already-cited Invention U.S. Pat. No. 1,298,367 in the name of this same Applicant. The picking elements 5 are conveniently of the articulated type and are provided with means 8 for gripping the boxes 2 from the magazine 3 and for releasing said boxes into the conveyor. The magazine 3 (FIG. 1) is of the type which comprises an inclined guide 9, along which the boxes 2 advance one next to the other toward the rotating drum 4, entrained by means which are not shown in the figures and are of a traditional type.

According to the invention, the conveyor 7 comprises advantageously at least one rotating carousel 10, which has a horizontal rotation axis which is parallel to the axis of the rotating drum 4 and forms a plurality of peripheral seats 11, which are adapted to accommodate the boxes 2 in the open configuration which are deposited by the grip and release means 8, so as to convey them in an orderly fashion toward the subsequent production stations.

Actuation means are provided which are supported in the footing of the machine and are not shown in the figures because they are of a known and substantially traditional type; such means are adapted to turn, with appropriate and preset peripheral speeds, the rotating drum 4 in the opposite direction with respect to the rotating carousel 10, so as to allow the continuous deposition of the open boxes 2 respectively from the grip and release means 8 to the peripheral seats 11 of the rotating carousel 10.

Each one of the picking elements 5, already described in Invention U.S. Pat. No. 1,298,367, comprises a first rocker 12 and a second rocker 13, which have two respective ends which are articulated to fixed points 14, 15 of the rotating drum 4, which are articulated at the opposite ends respectively to the mutually opposite end portions of a link 16 and of a rod 17, which are mutually articulated, so as to form a sort of articulated pentagon which lies on a plane which is substantially perpendicular to the rotation axis of the rotating drum 4. The grip and release means 8 for the boxes 2 are advantageously rigidly coupled to the link 16.

The grip and release means 8 conveniently comprise, for each one of the picking elements 5, at least one sucker 18, which is functionally connected to suction means, which are not shown in the figures but are fully known and are adapted to control selectively the sucker 18 so that it retains each box 2 in the flattened configuration after removing it from the magazine 3 and deposits it, in the open configuration, in one of the peripheral seats 11.

The cam means, as described in Invention U.S. Pat. No. 1,298,367, comprise at least one ring, which is rigidly coupled to the footing of the machine concentrically with respect to the rotation axis of the rotating drum 4 and is affected on its surface by a plurality of tracks having a predefined profile which are closed around the axis of the drum, and at least one first roller and one second roller, which are associated rotatably respectively with the free ends of the first rocker 12 and of the second rocker 13 of each one of the picking elements 5; in particular, the first and second rollers are guided positively respectively along a first one and a second one of the tracks of the ring.

The first track and the second track of the cam means have respective profiles which are adapted to form sequentially, in the motion of each one of the picking elements 5, at least one first step or actuation, in which the link 16 moves toward the magazine 3, adapting its peripheral speed, so as to allow the grip means 8 to pick a box 2; at least one second step or actuation, in which the opening means 6 entrain the wall 2*a* of the box 2, making it assume an open configuration; and at least one third step or actuation, in which the link 16 performs a translational motion in a direction which is substantially radial with respect to the rotating drum 4, adapting its peripheral speed with respect to the speed of the rotating carousel 10 and its inclination with respect to the tangent with respect to said carousel, allowing the release means 8 to deposit the box 2 in the peripheral seat 11 of the rotating carousel 10.

Figures 2, 2A:
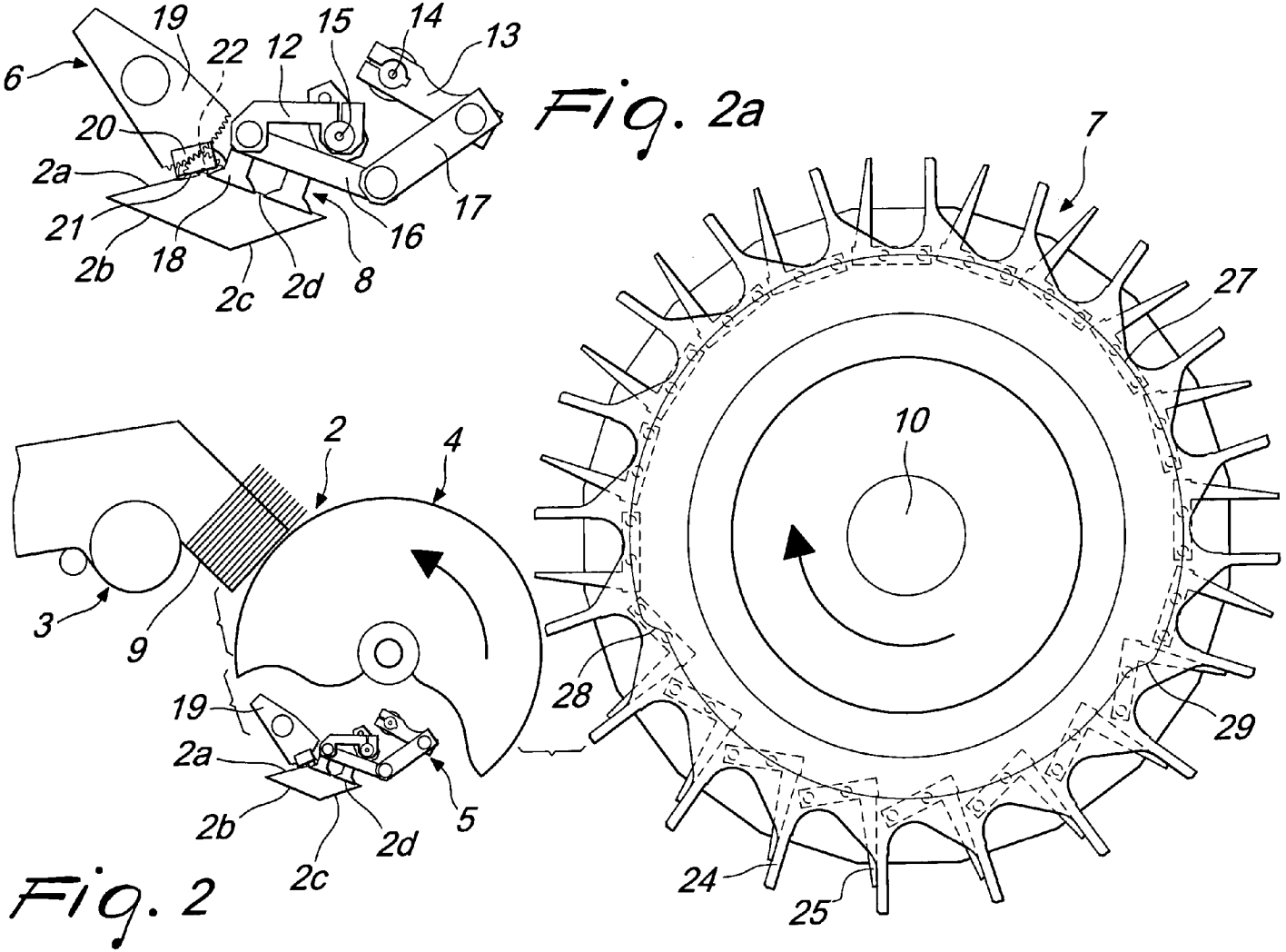
FIG. 2 is a detail front view of the device according to the invention during the opening of said box.
FIG. 2*a* is a view of another detail of FIG. 2.

The opening means 6 (reference should be made to FIG. 2*a*) comprise conveniently, for each one of the picking elements 5, a toothed sector 19, which is articulated to the rotating drum 4 and is provided with a wheel which is guided positively along a third one of the tracks provided on the ring of the cam means, a secondary shaft 20, which is supported rotatably in the rotating drum 4 and is provided, at one end, with at least one opening sucker 21 adapted to adhere to the wall 2*a* of each box 2 and, at the other end, a toothed pinion 22, which meshes with the sector 19. The third track has such a profile as to determine the rotation of the secondary shaft 20 about its own axis between two mutually opposite terminal angular positions, one for the adhesion of the opening sucker 21 to the wall 2*a* of the box 2 and one for the full opening of the box 2. The opening sucker 21 is functionally connected to suction means, which are not shown in the figures but are entirely known and are adapted to actuate selectively the sucker so as to adhere to the wall 2*a* of each box 2 in the flattened configuration and to release the wall 2*a* once the box has been opened.

Conveniently, each one of the peripheral seats 11 of the rotating carousel 10 comprises respective active grip elements 23, which are adapted to retain the boxes 2 in the open configuration. The active grip elements 23 comprise, for each one of the peripheral seats 11, a clamp which is constituted by a fixed element 24, which is arranged substantially radially, and a movable element 25, which is actuated so as to rotate about an axis 26 which is rigidly coupled to the rotating carousel 10 and is perpendicular thereto, from an angular position for retaining the box 2 in the open configuration to an angular position for releasing the box 2 and vice versa.

The rotating carousel comprises, for this purpose, a circular cam 27, which is concentric thereto and along which a cam follower is guided which is associated with the movable element 25 of the clamp, and there is a sort of step 28, which is adapted to turn the movable element 25 from the angular retention position to the angular release position and vice versa. A complementary step 29 is provided diametrically opposite and determines the reopening of the movable element 25 in order to transfer the boxes 2 to subsequent production stations.

Figure 3:
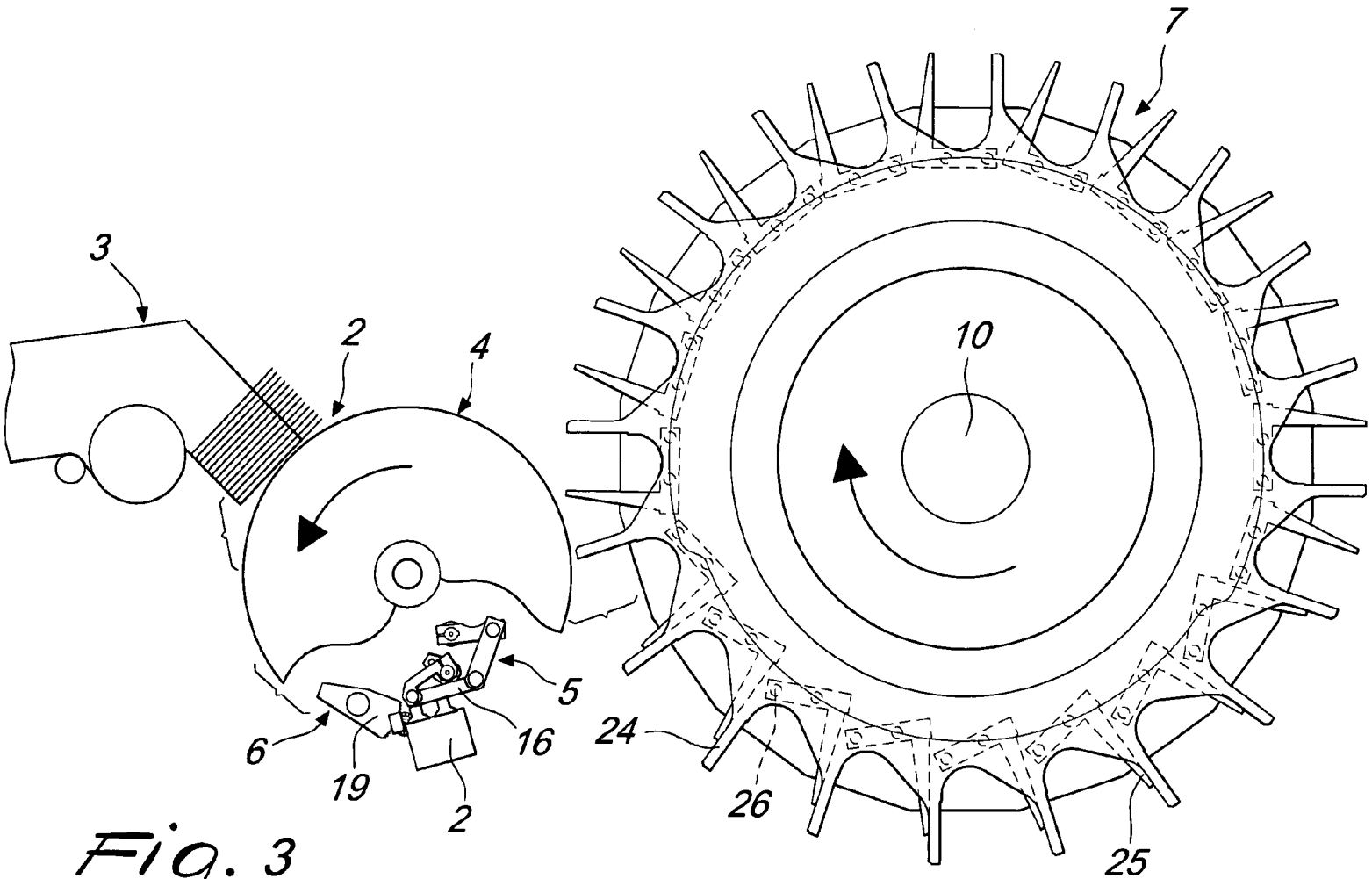
FIG. 3 is a detail front view of the device after the box has been opened completely.
Figure 4:
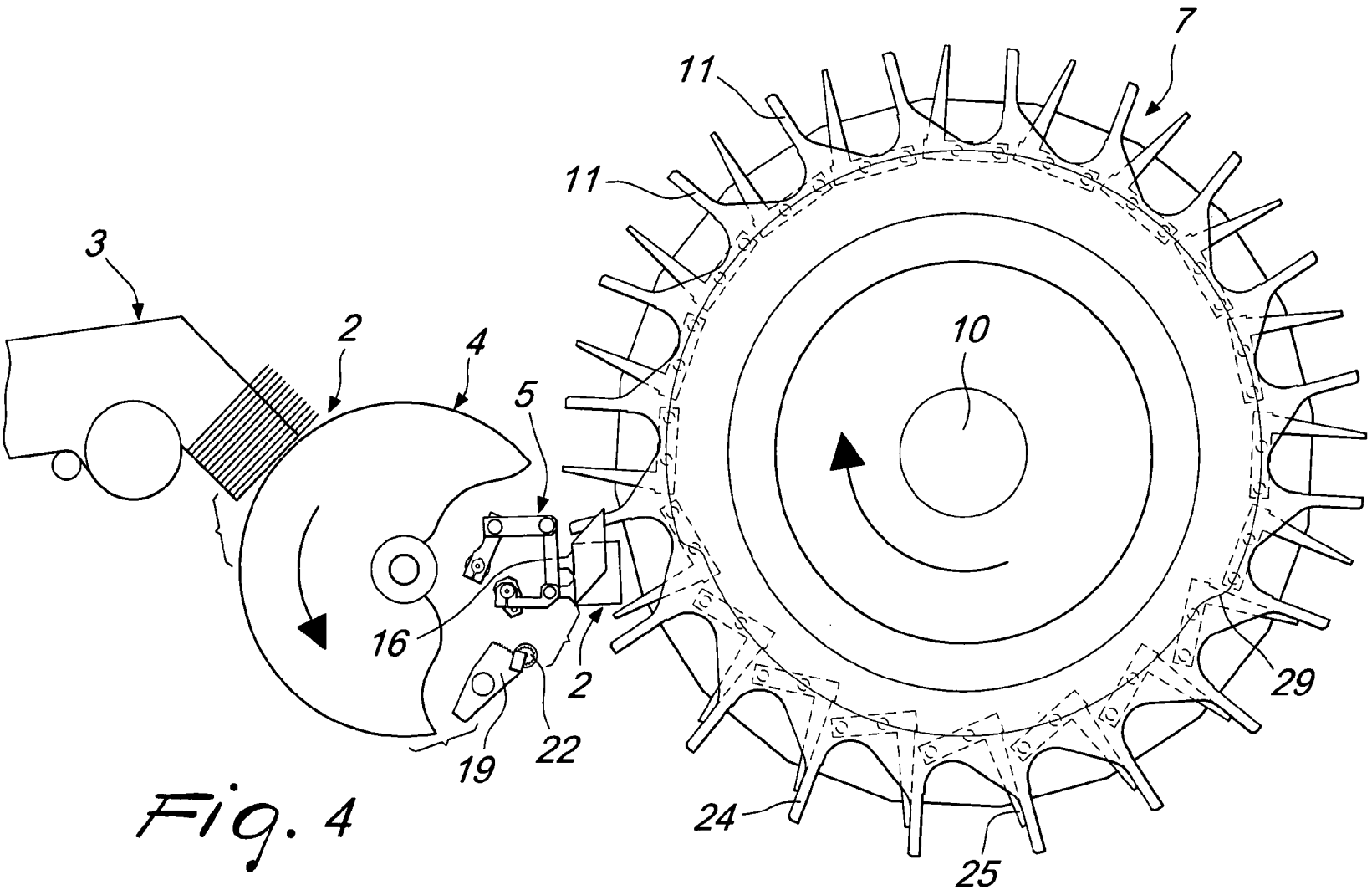
FIG. 4 is a detail front view of the device according to the invention during the insertion of the box in the open configuration within a respective peripheral seat of the rotating carousel.
Figure 5:
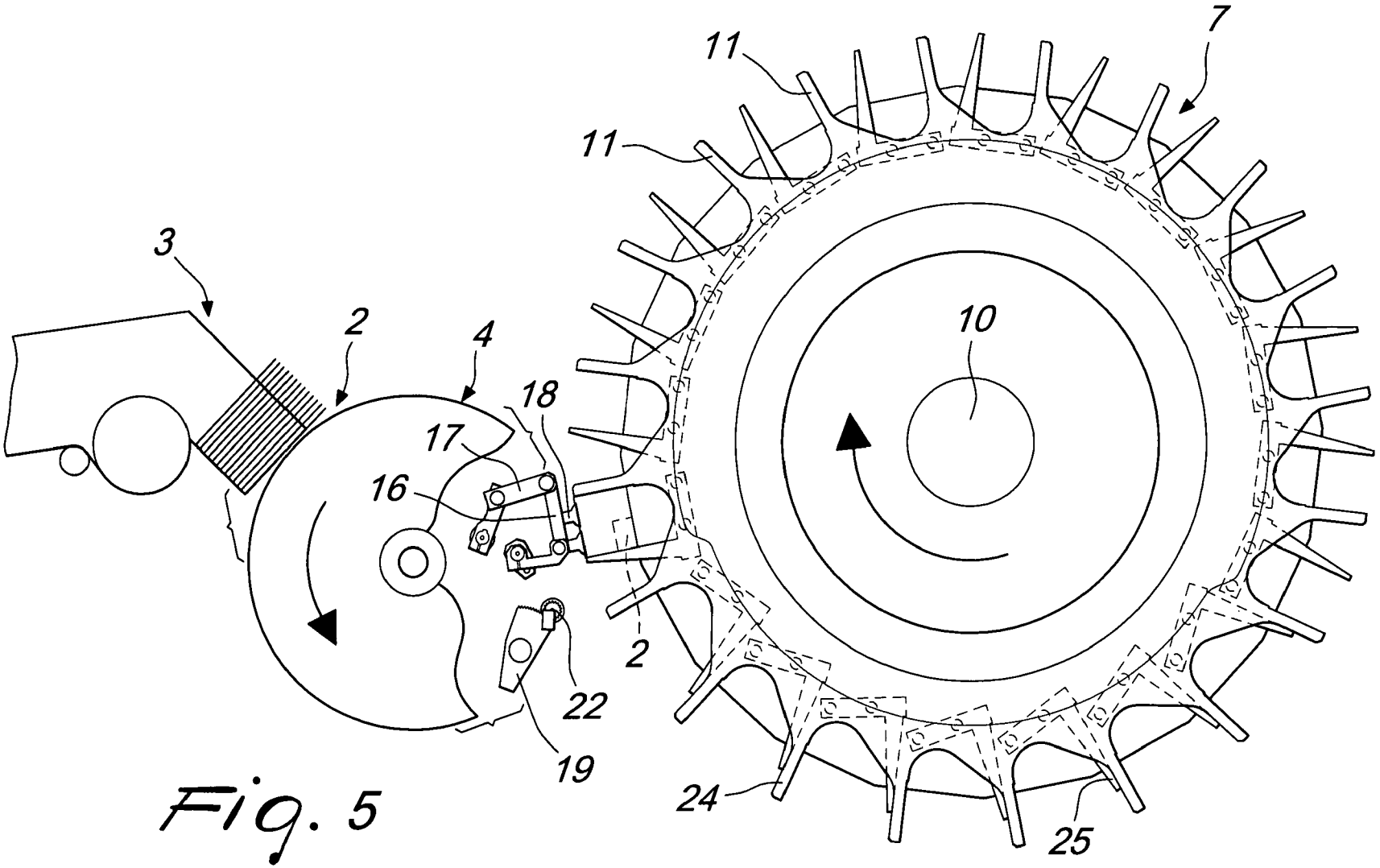
FIG. 5 is a detail front view of said device with said box completely accommodated in the respective seat of the rotating carousel.

The operation of the device according to the invention is evident in view of what has been described. In a first step (FIG. 1), the picking elements 5 actuated by the cam means grip a box 2 from the magazine 3: this occurs easily by way of the adaptation of the peripheral speed of the rotating drum 4 and in particular of the link 16. In a subsequent step (FIG. 2), after the drum 4 has turned through a preset angle, the box 2 opens: in detail, the cam means move the link 16 (provided with the box 2) toward the opening means 6, and the simultaneous rotation of the secondary shaft 20 about its own axis allows the adhesion of the opening sucker 21 to the wall 2*a*. The contrarotation of the secondary shaft 20 then provides the actual complete opening of the box 2 by entraining the wall 2*a* (FIG. 3). Subsequently, the cam means produce a radial translational motion of the link 16 toward the rotating carousel 10, providing the insertion of the open box 2 in a respective peripheral seat, by way of the appropriate synchronization of the peripheral speeds of the rotating drum 4 and of the carousel 10, and by means of the inclination of the link 16 (FIG. 4). The open box 2 is then clamped between the fixed element 24 and the movable element 25 (FIG. 5), by way of the interaction between the movable element 25 and the circular cam 27. The boxes are then conveyed toward other production stations, for example stations for filling the boxes with the products to be packaged.

It has thus been shown that the invention achieves the proposed aim and objects. The device is extremely flexible and versatile and is capable of handling boxes in the most disparate formats (reference should be made, for example, to the small box shown in discontinuous lines in FIG. 5). In practical operation, the device has proved to be adapted to obviate the above-mentioned drawbacks.

The invention thus conceived is susceptible of numerous modifications and variations, all of which are within the scope of the appended claims.

All the details may further be replaced with other technically equivalent ones.

The embodiment of the present invention shall be carried out in the most scrupulous compliance with the statutory and regulatory provisions related to the products of the invention or correlated thereto and following any required authorization of the corresponding competent authorities, with particular reference to regulations related to safety, environmental pollution and health.

In practice, the materials used, as well as the shapes and the dimensions, may be any according to requirements without thereby abandoning the scope of the protection of the appended claims.

The disclosures in Italian Patent Application No. BO2005A000212 from which this application claims priority are incorporated herein by reference.

What is claimed is:

1. A device for picking and opening boxes suitable for packaging products that is supported on a footing of a packaging machine, comprising: at least one magazine for substantially paraflelepiped boxes arranged in a flattened configuration; at least one rotating drum which is provided peripherally with picking elements for picking the boxes one by one from said magazine and with opening means for opening the boxes; at least one conveyor for conveying the boxes in the open configuration from said rotating drum toward successive production stations of a product packaging process line; and cam means for actuating said box picking elements and said box opening means and which comprise at least one ring, which is rigidly coupled to the footing of the machine concentrically with respect to a rotation axis of said drum, said ring having on its surface a plurality of tracks having a predefined profile with a closed configuration that lay around the drum axis, and at least one first roller and one second roller tat are rotatably associated, respectively, with the free ends of said first rocker and of said second rocker of each one of said picking elements, said first and second rollers being guided positively respectively along a first one and a second one of said tracks of said ring; wherein said picking elements are provided with grip and release means for gripping the boxes from said magazine and for releasing the boxes onto said conveyor, each one of said picking elements comprising a link, a rod and a first and a second rocker, said first and second rockers having two respective first ends thereof articulated to fixed points of said rotating drum and being further articulated at opposite second ends thereof, respectively, to mutually opposite end portions of said link and of said rod, the link and the rod being further mutually articulated so as to form an articulated pentagon which lies on a plane which is substantially perpendicular to the rotation axis of said rotating drum, said link being provided with said grip and release mean; wherein said conveyor comprises at least one rotating carousel, which has a rotation axis which is parallel to an axis of said rotating drum and forms a plurality of peripheral seats, which are adapted to acconunodate the boxes in an open configuration deposited by said grip and release means so as to convey the boxes in an orderly fashion toward the subsequent production stations; and wherein the predefined profile of first and second ones of said tracks is adapted to provide sequentially and during motion of each one of said picking elements at least one first actuation in which said link moves toward said magazine adapting its peripheral speed so as to allow said grip and release means to pick up a box, at least one second actuation in which said opening means entrain one wall of the box and moves said wall to an open configuration, and at least one third actuation in which said link moves in a substantially radial direction adapting its peripheral speed with respect to a speed of said rotating carousel and an inclination thereof with respect to a tangent thereto, allowing said grip and release means to deposit the box in said peripheral seat of said rotating carousel.

2. The device of claim 1, further comprising actuation means which are suitable to turn, with adapted and predefined peripheral speeds, said rotating drum in an opposite direction with respect to said rotating carousel, so as to allow deposition of the boxes opened by said grip and release means into said peripheral seats.

3. The device of claim 2, wherein each one of said peripheral seats of said rotating carousel comprises respective active grip elements, which are adapted to retain the boxes in the open configuration.

4. The device of claim 3, wherein said active grip elements comprise:

a clamp which is constituted by a fixed element, which is arranged substantially radially; and a movable element, which is actuated so as to turn about an axis which is rigidly coupled to said rotating carousel and perpendicular thereto, from an angular position for retaining the box in the open configuration to an angular position for releasing said box and vice versa.

5. The device of claim 4, wherein said rotating carousel comprises a circular cam, which is concentric thereto with a cam follower guided therealong, said cam follower being associated with said movable element of said clamp, so as to turn said movable element from said angular retention position to said angular release position and vice versa.

6. The device of claim 3, wherein said grip and release means comprise, for each one of said picking elements, at least one sucker, which is functionally connected to suction means adapted to control selectively said sucker so as to retain each box in a flattened configuration after picking the box up from said magazine and deposit the box, in the open configuration, in one of said peripheral seats.

7. The device of claim 1, wherein said opening means comprise: for each one of said picking elements, a toothed sector, which is articulated to said drum and is provided with a wheel which is guided positively along a third one of said tracks of said ring; a secondary shaft, which is supported so as to rotate in said rotating drum and has, at one end, at least one opening sucker, which is adapted to adhere to one of the walls of each box, and, at the other end, a toothed pinion, which meshes with said sector, said third track having such a profile as to determine rotation of such secondary shaft, about its own axis, between two mutually opposite angular end positions, of which one is for adhesion of said sucker to the wall of the box and one is for a complete opening of said box.

8. The device of claim 7, comprising suction means, said opening sucker being functionally connected to said suction means, which are adapted to control selectively said sucker so as to adhere to one of the walls of each box in the flattened configuration and to release said wall once the box has been opened.

9. The device of claim 1, wherein said production stations comprise at least one automatic station for filling the boxes with the products to be packaged.

10. A device for picking and opening boxes suitable for packaging products that is supported on a footing of a packaging machine, comprising: at least one magazine for substantially parallelepiped boxes arranged in a flattened configuration; at least one rotating drum which is provided peripherally with picking elements for picking the boxes one by one from said magazine and with opening means for opening the boxes;

at least one conveyor for conveying the boxes in the open configuration from said rotating drum toward successive production stations of a product packaging process line; and cam means for actuating said box picking elements and said box opening means and which comprise at least one ring, which is rigidly coupled to the footing of the machine concentrically with respect to a rotation axis of said drum, said ring having on its surface a plurality of tracks having a predefined profile with a closed configuration that lay around the drum axis, and at least one first roller and one second roller that are rotatably associated, respectively, with the free ends of said first rocker and of said second rocker of each one of said picking elements, said first and second rollers being guided positively respectively along a first one and a second one of said tracks of said ring;

wherein said picking elements are provided with grip and release means for gripping the boxes from said magazine and for releasing the boxes onto said conveyor, each one of said picking elements comprising a link, a rod and a first and a second rocker, said first and second rockers having two respective first ends thereof articulated to fixed points of said rotating drum and being further articulated at opposite second ends thereof, respectively, to mutually opposite end portions of said link and of said rod, the link and the rod being further mutually articulated so as to form an articulated pentagon which lies on a plane which is substantially perpendicular to the rotation axis of said rotating drum, said link being provided with said grip and release mean;

wherein said conveyor comprises at least one rotating carousel, which has a rotation axis which is parallel to an axis of said rotating drum and forms a plurality of peripheral seats, which are adapted to accommodate the boxes in an open configuration deposited by said grip and release means so as to convey the boxes in an orderly fashion toward the subsequent production stations;

wherein the predefined profile of first and second ones of said tracks is adapted to provide sequentially and during motion of each one of said picking elements at least one first actuation in which said link moves toward said magazine adapting its peripheral speed so as to allow said grip and release means to pick up a box, at least one second actuation in which said opening means entrain one wall of the box and moves said wall to an open configuration, and at least one third actuation in which said link moves in a substantially radial direction adapting its peripheral speed with respect to a speed of said rotating carousel and an inclination thereof with respect to a tangent thereto, allowing said grip and release means to deposit the box in said peripheral seat of said rotating carousel; and wherein each one of said opening means comprise a tooted sector articulated to said rotating drum and provided with a wheel which is guided positively along a third one of said tracks of said at least one ring, a secondary shaft supported so as to rotate in said rotating drum and having at a first end thereof at least one opening sucker adapted to adhere to a wall of a box and having at a second end thereof a toothed pinion, said toothed pinion meshing with said sector, said third track having such the predetermined profile such as to determine rotation of said secondary shaft about its own axis between two mutually opposite angular end positions, of which a first end position is for adhesion of said sucker to the wall of the box and a second end position is for a complete opening of said box.

11. The device of claim 10, comprising suction means, said opening sucker being functionally connected to said suction means, which are adapted to control selectively said sucker so as to adhere to one of the walls of each box in the flattened configuration and to release said wall once the box has been opened.

12. The device of claim 10, further comprising actuation means which are suitable to turn, with adapted and predefined peripheral speeds, said rotating drum in an opposite direction with respect to said rotating carousel, so as to allow deposition of the boxes opened by said grip and release means into said peripheral seats.

13. The device of claim 12, wherein each one of said peripheral seats of said rotating carousel comprises respective active grip elements, which are adapted to retain the boxes in the open configuration.

14. The device of claim 13, wherein said active grip elements comprise: a clamp which is constituted by a fixed element, which is arranged substantially radially; and a movable element, which is actuated so as to turn about an axis which is rigidly coupled to said rotating carousel and perpendicular thereto, from an angular position for retaining the box in the open configuration to an angular position for releasing said box and vice versa.

15. The device of claim 14, wherein said rotating carousel comprises a circular cam, which is concentric thereto with a cam follower guided therealong, said corn follower being associated with said movable element of said clamp, so as to turn said movable element from said angular retention position to said angular release position and vice versa.

16. The device of claim 13, wherein said grip and release means comprise, for each one of said picking elements, at least one sucker, which is functionally connected to suction means adapted to control selectively said sucker so as to retain each box in a flattened configuration after picking the box up from said magazine and deposit the box, in the open configuration, in one of said peripheral seats.

* * * * *